United States Patent [19]

McCarthy

[11] Patent Number: 4,934,553

[45] Date of Patent: Jun. 19, 1990

[54] ABOVE GROUND WASTE TANK

[75] Inventor: Walton McCarthy, Concord, N.H.

[73] Assignee: ThetaCorporation, Bothell, Wash.

[21] Appl. No.: 332,537

[22] Filed: Apr. 3, 1989

[51] Int. Cl.[5] ..... B65D 90/04

[52] U.S. Cl. ..... 220/454; 220/1 B; 220/85 S; 220/469; 220/902

[58] Field of Search ..... 206/524.2, 524.3, 524.9; 220/1 B, 5 A, 18, 85 S, 445–447, 466, 454, 469, 456, 902

[56] References Cited

U.S. PATENT DOCUMENTS

| | | | |
|---|---|---|---|
| 2,952,987 | 9/1960 | Clauson | 220/454 |
| 3,951,190 | 4/1976 | Suter | 220/1 B |
| 3,952,907 | 4/1976 | Ogden et al. | 220/18 |
| 3,993,213 | 11/1976 | Burge et al. | 220/902 |
| 3,996,945 | 12/1976 | McDowell | 220/902 |
| 4,109,823 | 8/1978 | Ffooks et al. | 220/456 |
| 4,361,190 | 11/1982 | Szego | 220/88 A |
| 4,578,406 | 3/1986 | Volz | 244/1 A |
| 4,685,327 | 8/1987 | Sharp | 220/469 |

FOREIGN PATENT DOCUMENTS

| | | | |
|---|---|---|---|
| 2416420 | 10/1979 | France | 220/902 |

*Primary Examiner*—Jimmy G. Foster

[57] ABSTRACT

An above ground tank for the storage of flammable and combustible liquids consisting of an outer vessel of fiberglass construction and an inner vessel of similar construction eccentrically mounted within the outer vessel. The outer surface of the inner vessel and the underside of the cover is provided with an intumescent coating to foam up as a thermal barrier upon reaching a critical elevated temperature to resist the increase in temperature of the contents of the tank. The tank is supplied with a fiberglass filler funnel and a manway with a cover on which is mounted all of the pipe fittings required for the tank.

15 Claims, 2 Drawing Sheets

ABOVE GROUND WASTE TANK

BACKGROUND OF THE INVENTION

The present invention relates to an above ground liquid waste storage tank and more particularly to an above ground waste storage tank having improved capability to store flammable and combustible liquids.

In my patent application Ser. No. 07/294,717 for "Underground Storage Tank" filed on Jan. 9, 1989, I disclose and claim an underground storage tank for chemicals constructed out of fiberglass. In many situations it is necessary to store such chemicals in tanks which are above ground. Tanks which are designed for use underground are not normally suitable for use in a more exposed environment.

Typical above ground waste storage tanks for flammable and combustible liquids are made out of steel and are subject to problems of corrosion which limit their useful life, especially when they are being used to contain dangerous fluids. In addition, in the event of a fire outside the tank, the steel being an excellent conductor of heat rapidly transfers the heat into the liquid contained therein, thus increasing the hazard of spreading the fire. Other problems associated with steel tanks have to do with problems of moisture condensing out on the inside of the tank, the danger of sparks igniting the fluid contained in the tank, and the weight of the tank requiring a concrete foundation for its support.

Tanks which are made out of fiberglass generally tend to adhere to existing designs, merely substituting fiberglass for the steel. Such tanks are unable to meet the one hour fire code rating, which will be described below.

SUMMARY OF THE INVENTION

In this invention the problems and drawbacks associated with presently available above ground storage tanks for flammable and combustible liquids are either avoided or reduced.

In a preferred embodiment of the invention there is provided a double-walled tank made from fiberglass reinforced plastic (FRP), also referred to herein as fiberglass, in which the inner and outer walls are will avoid the generation of sparks during operation or, in the event a vehicle collides with the tank will slow down the progress of any fire, and readily permit the recognition of any leak or spill.

The present invention concerns in particular the storage of various chemicals and petroleum products such as unleaded gasoline, leaded gasoline, gasohol (10% ethanol), jet fuel, kerosene, diesel fuel, fuel, and water. The maximum storage temperature which is a candidate for use in this invention is about 150 deg. F.

It is thus a principal object of this invention to provide an above ground storage tank for flammable and combustible liquids with improved safety characteristics.

Other objects and advantages of this invention will hereinafter become obvious from the following description of a preferred embodiment of this invention.

DETAILED DESCRIPTION OF THE PREFERRED EMBODIMENT

Figure 1:
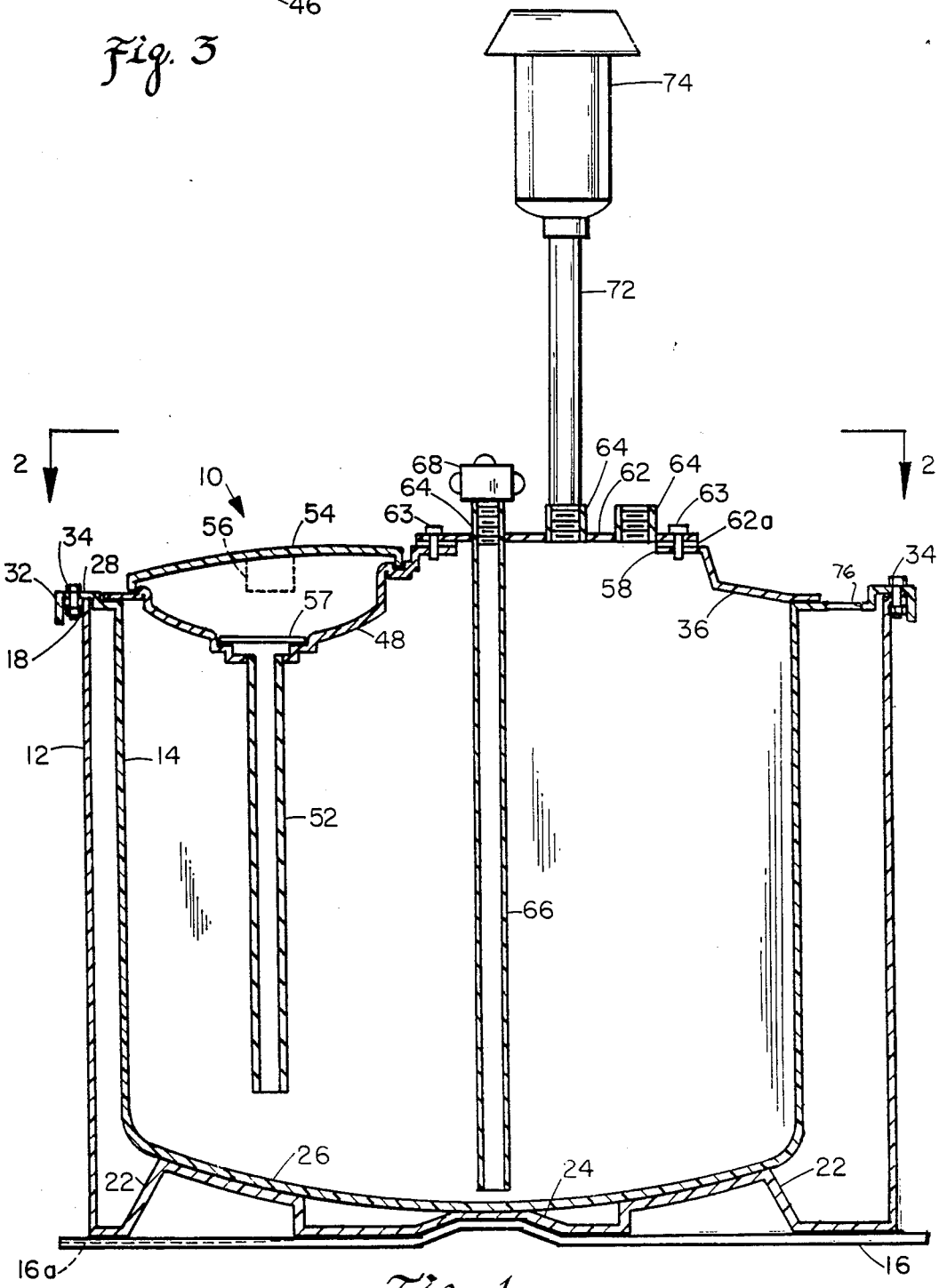
FIG. 1 is an elevation view in section of a preferred embodiment of this invention, taken along 1—1 of FIG. 2.
Figure 2:
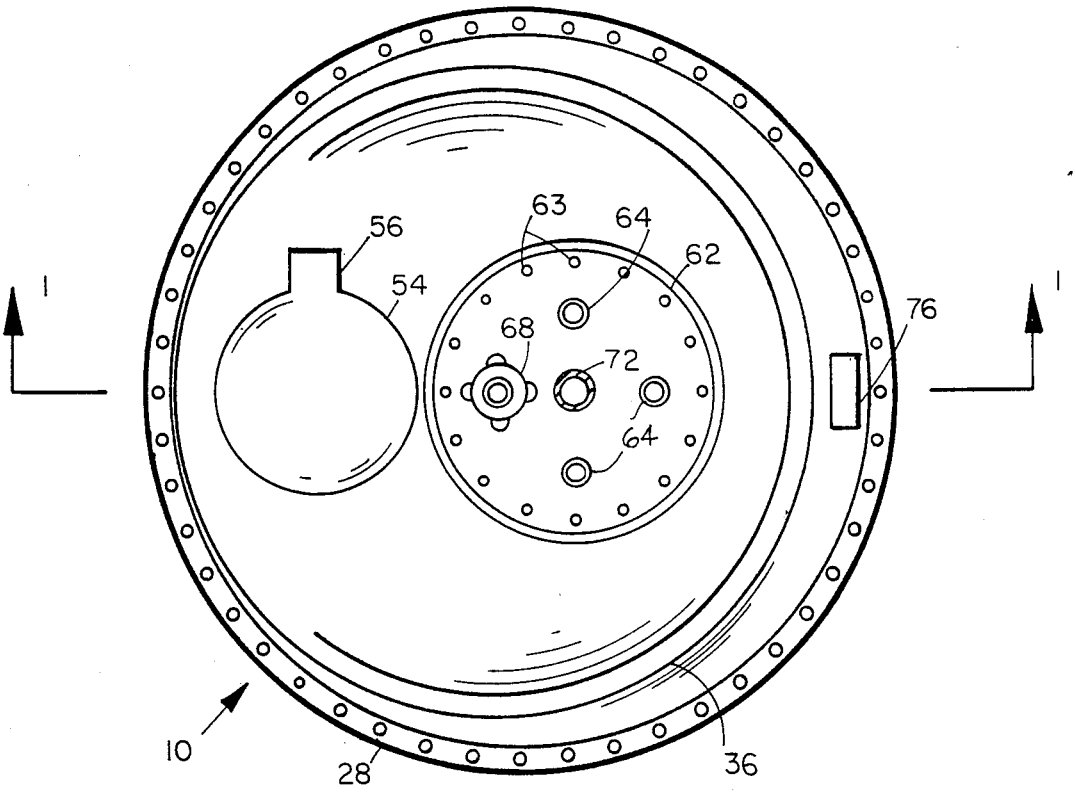
FIG. 2 is a plan view of the preferred embodiment of this invention taken along 2—2 of FIG. 1.

Referring to FIGS. 1 and 2, above ground waste liquid tank 10 consists of a cylindrical, open mouth outer vessel 12, and a cylindrical open mouth inner vessel 14, both of molded fiberglass construction, resting on a fiberglass base plate 16 which would be provided with one or more channels **16*a* to trap any leaking fluid which can thus be easily identified. Plate 16** would be placed and mounted in any convenient location.

Outer vessel 12 is cylindrical, circular in cross section, and open at the top having an annular flange 18 for a purpose to be described later. The bottom of vessel 12 includes an annular, sloped shoulder 22 forming a cradle, and a centrally located platform 24, for the support of inner vessel 14.

Inner vessel 14 is cylindrical with a dished bottom 26 for resting on annular shoulder 22 and platform 24. Bottom 26 slopes toward the center so that all liquid will drain to the center of the tank, insuring as will be seen later the virtually complete removal of liquid then required.

Vessel 14, which is circular in cross section is located off center, or eccentrically, with respect to vessel 12 for a purpose to be described later. The top of vessel 14 is provided with a flange 28 which folds over flange 18 of outer vessel 12 forming a downwardly extending annular skirt 32 to hide the joint. A plurality of stainless steel bolts 34 with nuts clamp the two vessels together in the manner illustrated.

Figure 3:
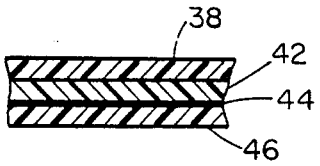
FIG. 3 shows a detail in section of the cover.

Tank 10 is provided with a cover 36 which consists, as shown in FIG. 3, of a formed molded sheet 38 of fiberglass, a layer 42 of open-celled foam which is impregnated or sprayed with an intumescent liquid material, a sheet of a plastic film 44 such as Mylar, and an enclosing layer 46 of fiberglass. This sandwich construction has several advantages. The intumescent material at a certain temperature, or upon coming in contact with an open flame, will foam up to act as a very effective thermal barrier. Such materials are available commercially. The layered construction of cover 36 insures sufficient rigidity to support the other features of cover 36 which will now be described. The outer surface of inner vessel 14 is also coated with intumescent material.

Incorporated into and being an integral part of cover 36 is an open top funnel 48 and a steel filler tube 52 extending downwardly into the interior of vessel 14 for delivering into the latter the liquid to be stored. Supported above funnel 48 by cover 36 is a hinged funnel cover 54 supported by a hinge 56 mounted on cover 36. Mounted in funnel 48 is an aluminum screen 57. The sloping funnel 48 is designed to keep water from entering tank 10. The use of a fiberglass funnel insures that no sparks will be generated from metallic filling buckets in contact with fill funnel 48. A hasp (not shown) may be provided to permit the user to lock the tank access.

Adjacent funnel 48 is a circular opening or manway 58 over which is mounted a steel manway cover 62 which is held in place by screws 63 attached by threaded, metallic inserts mounted through the sandwiched construction of cover 36, and using a standard gasket **62*a* conforming to American Society Standards Institute (ANSI) flanges. Manway 58** allows easy access for servicing such as cleaning of the waste tank and keeps all the fittings in one area.

Incorporated into manway cover 62 are a plurality of threaded metal National Pipe Thread (NPT) couplings 64 welded to cover 62 to provide access through cover 62 and having threaded interiors for attaching accessories. One such accessory is steel withdrawal tube 66 extending down into vessel 14 for withdrawing liquid as required. Tube 66 is located in the center of vessel 14 and terminates close to lowest point of dished bottom 26. A threaded cap 68 keeps the top of tube 66 closed and may be removed in order to withdraw some of the fluid therein.

Another use of one of the couplings 64 is shown by the threaded attachment of a steel vent pipe 72 the top of which is provided with an aluminum flame arrester 74, which as known in the art contains baffles to prevent flames from spewing out.

The remaining couplings 64 may be provided with steel plugs to close off the openings except when access is required.

Between inner vessel 14 and outer vessel 12, flange 28 is provided a sight port 76 which can be made quite large in view of the eccentricity of inner vessel 14 with respect to vessel 12. Sight port 76 may be provided with a transparent member such as glass or quartz, or may be left open for inserting a probe or other device, and capped if desired when not being used.

Tank cover 36, inner wall 14, and outer wall 12 are made of structural fiberglass and independently replaceable. The inside of the tank is provided with a mild polished finish for ease of cleaning and to facilitate draining of liquid down. Since the base and both vessels are of fiberglass construction, there is virtually no possibility of static being generated to ignite a leak in the event of a vehicle hitting the tank.

In the use of tank 10, it is shipped to its site of installation completely assembled and ready for use. Tank 10 is filled by opening hinged funnel cover 54 and pouring the flammable fluid into funnel 48. To remove fluid from inside tank 10, cap 68 is removed and the fluid is pumped out of tank through tube 66.

The design of tank 10 involving the use of two fiberglass vessels and the intumescent coating on the exterior surfaces of inner vessel 14 and the use of such coating material in the foam employed under cover 36 gives tank 10 a one hour fire rating in compliance with the ASTM E-119 Time Temperature Curve. This means that should a fire outside of tank 10 reach the latter, there will be at least an hour before the contents of tank 10 reach ignition temperature. This extended fire rating resulting from the design which as has been described is an important feature of this invention.

It is thus seen that there has been provided an improved above ground storage tank for flammable and combustible liquids. While only a preferred embodiment of this invention has been described it is understood that many variations thereof are possible without departing from the principles of this invention as defined in the claims which follow.

What is claimed is:

1. An above ground liquid storage tank comprising:

a. an outer open top cylindrical vessel of molded fiberglass;

b. an inner open top cylindrical vessel of molded fiberglass located within said outer vessel, said inner vessel being located eccentrically with respect to said outer vessel such that the spacing between the walls of the outer and inner vessels varies circumferentially from a maximum to a minimum;

c. means closing the annular opening into the space between the inner and outer vessels;

d. cover means of molded fiberglass construction closing the opening into said inner vessel;

e. said cover means including a first opening, means mounted within said first opening for receiving liquid for filling said tank, and a second opening large enough to accomodate a person having closure means for accomodating all pipe fittings associated with the operation of said tank; and f. means coating the underside of said cover means and the outer surface of said inner vessel to produce a thermal barrier in response to the temperature reaching a predetermined, elevated value.

2. The liquid storage tank of claim 1 wherein said closing means comprises said outer vessel having an outwardly extending annular flange at the top opening thereof, and said inner vessel having an outwardly extending flange passing over the flange of said outer vessel.

3. The liquid storage tank of claim 1 wherein the bottom of said outer vessel forms an annular, sloped shoulder and a platform to support said inner vessel.

4. The liquid storage tank of claim 2 wherein the outer vessel flange includes sight opening means in a region of large spacing between said vessels in order to provide improved access to the annular space between said vessels.

5. The liquid storage tank of claim 1 wherein said coating means comprises intumescent material.

6. The liquid storage tank of claim 1 wherein said closure means is of metal construction and supports all metal fittings associated with said tank including means for withdrawing liquid from said tank and venting means.

7. The liquid storage tank of claim 1 wherein said cover means includes funnel means of fiberglass construction formed as part of said first opening for receiving liquid to fill said tank, the bottom of said funnel means supporting and communicating with a pipe extending down into said inner vessel.

8. The liquid storage tank of claim 7 in which said funnel means includes a screen to filter liquid entering said pipe.

9. The liquid storage tank of claim 8 in which the first opening is sloped and is provided with a hinged cover to prevent water from entering said tank.

10. The liquid storage tank of claim 6 in which said venting means includes a flame arrester.

11. The liquid storage tank of claim 1 having means to channel any leaking liquid at the bottom of said tank.

12. An above ground storage tank for flammable liquids having an extended fire rating comprising:

a. an outer open top cylindrical vessel of molded fiberglass;

b. an inner open top cylindrical vessel of molded fiberglass located within said outer vessel;

c. the bottom of said outer vessel having means to support said inner vessel; and d. cover means of molded fiberglass construction closing the opening into said inner vessel, the underside of said cover means and the outer surface of said inner vessel being coated with a material which upon reaching a predetermined temperature or coming into contact with an open flame will foam up to act as an effective thermal barrier.

13. The storage tank of claim 12 wherein the material on the underside of said cover means includes a layer of open celled foam impregnated with intumescent material.

14. The storage tank of claim 12 wherein said cover means includes a first opening and cover for permitting liquid to be added to said tank and a second opening and cover to permit human access to the interior of said inner vessel.

15. The storage tank of claim 14 wherein said second opening cover includes plumbing for liquid withdrawal and ventilation of said inner vessel.

* * * * *